US008777220B2

(12) United States Patent
Oshiro et al.

(10) Patent No.: US 8,777,220 B2
(45) Date of Patent: Jul. 15, 2014

(54) SHEET FEEDING DEVICE AND SHEET FEEDING METHOD

(75) Inventors: Toshiaki Oshiro, Shizuoka-ken (JP); Yoichi Yamaguchi, Shizuoka-ken (JP); Isao Yahata, Shizuoka-ken (JP); Takahiro Kawaguchi, Shizuoka-ken (JP); Yoshiaki Sugizaki, Shizuoka-ken (JP); Kikuo Mizutani, Shizuoka-ken (JP); Hiroyuki Taki, Shizuoka-ken (JP); Hiroyuki Tsuchihashi, Shizuoka-ken (JP); Chiaki Iizuka, Shizuoka-ken (JP); Hidetoshi Yokochi, Shizuoka-ken (JP); Ken Iguchi, Shizuoka-ken (JP); Hiroyuki Hazu, Shizuoka-ken (JP); Hiroyuki Sugiyama, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/533,914

(22) Filed: Jun. 26, 2012

(65) Prior Publication Data

US 2013/0001860 A1 Jan. 3, 2013

Related U.S. Application Data

(60) Provisional application No. 61/502,218, filed on Jun. 28, 2011, provisional application No. 61/508,491, filed on Jul. 15, 2011.

(51) Int. Cl.
*B65H 7/02* (2006.01)
*B65H 3/52* (2006.01)

(52) U.S. Cl.
USPC ..... 271/258.01; 271/122; 271/265.01

(58) Field of Classification Search
USPC ..... 271/265.01, 265.04, 121, 122, 256, 271/258.01, 258.02
See application file for complete search history.

(56) References Cited

U.S. PATENT DOCUMENTS

| | | | | |
|---|---|---|---|---|
| 6,792,242 | B2 * | 9/2004 | Suzaki | 399/392 |
| 7,354,038 | B2 * | 4/2008 | Watase | 271/10.13 |
| 7,690,650 | B2 * | 4/2010 | Itoh et al. | 271/263 |
| 7,905,484 | B2 * | 3/2011 | Komuro | 271/263 |

(Continued)

FOREIGN PATENT DOCUMENTS

| | | | |
|---|---|---|---|
| JP | 2002-265083 | A | 9/2002 |
| JP | 2005-324938 | A | 11/2005 |

OTHER PUBLICATIONS

English translation of Japanese Office Action dated Feb. 18, 2014 in counterpart Japanese Application 2012-144985 (2 pages).

*Primary Examiner* — Patrick Cicchino
(74) *Attorney, Agent, or Firm* — Patterson & Sheridan, LLP

(57) ABSTRACT

In general, in a sheet feeding device of embodiments, a shaft connects through an one-way clutch structure to a conveying roller, rotates in a first direction and a second direction opposite to the first direction, transmits the torque to the conveying roller to cause the conveying roller to rotate in the first direction if the shaft rotates in the first direction. The shaft does not transmit the torque to the conveying roller if the shaft rotates in the second direction. The shaft limits the rotation of the conveying roller in the second direction while the shaft is in a rotation-stop state. A controller has a second mode in which the shaft is rotated in a second direction to allow rotation of the conveying roller in the second direction.

15 Claims, 9 Drawing Sheets

(56) References Cited

U.S. PATENT DOCUMENTS 8,328,190 B2 * 12/2012 Komuro ..... 271/263
2007/0085262 A1 * 4/2007 Mitsuya et al. ..... 271/121
2009/0096153 A1 4/2009 Katsura et al.
2011/0221853 A1 * 9/2011 Tsuchihashi et al. ..... 347/179

* cited by examiner

SHEET FEEDING DEVICE AND SHEET FEEDING METHOD

CROSS-REFERENCE TO RELATED APPLICATION

This application is based upon and claims the benefit of priority from U.S. provisional application 61/502,218, filed on Jun. 28, 2011; U.S. provisional application 61/508,491, filed on Jul. 15, 2011; the entire contents of which are incorporated herein by reference.

FIELD

Embodiments described herein relate generally to a technique that makes it easy to pull out a sheet from between a conveying roller and a separating roller upstream in a conveying direction.

BACKGROUND

Conventionally, an image forming apparatus includes a sheet feeding device that takes one sheet out of a cassette and conveys the sheet toward an image forming unit. In the sheet feeding device, the sheet taken out of the cassette by a pickup roller is fed in between a conveying roller and a separating roller working as a pair. If sheets are multi-fed in between the conveying roller and the separating roller, the separating roller stops travel of a sheet on a side on which the separating roller is placed, and the conveying roller feeds only one sheet on a side on which the conveying roller is placed toward a downstream in a sheet conveying direction.

A motor as a drive source for the conveying roller may also function to drive a registration roller placed downstream of the sheet conveying direction with respect to the conveying roller. In this case, a device is configured such that, when the motor is driven to rotate in one direction, the conveying roller is thereby driven, and that, when the motor is driven to rotate reversely, the registration roller is thereby driven. Further, in order to cut off transmission of torque (torque acting to convey a sheet in a return direction) from the motor to the conveying roller during the reverse rotation of the motor, a one-way clutch is provided in a mechanism for transmitting torque from the motor to the conveying roller. Only if torque acting in a feed direction in which the conveying roller feeds a sheet toward downstream in the conveying direction is input into the one-way clutch, the one-way clutch allows transmission of the torque from the motor to the conveying roller. If torque acting in the return direction opposite to the feed direction is input into the one-way clutch, the one-way clutch cuts off transmission of the torque from the motor to the conveying roller.

In the aforementioned sheet feeding device, if tightly contacting sheets that are a bundle of sheets from which a staple has been removed, for example, are multi-fed in between the conveying roller and the separating roller, the sheets cannot be separated from each other to become separate sheets between the conveying roller and the separating roller. In this case, a multi-feed detecting sensor provided downstream of the sheet conveying direction with respect to the conveying roller detects multi-feed of the sheets. A user is notified of the multi-feed of the sheets, and convey of the sheets is stopped. Then, the user is required to pull out the sheets held between the conveying roller and the separating roller upstream in the sheet conveying direction by hand and remove the sheets from between the conveying roller and the separating roller.

However, as a result of provision of the one-way clutch in the mechanism for transmitting torque from the motor to the conveying roller, rotation of the conveying roller in the return direction while the motor stops is limited by the one-way clutch. Accordingly, conventionally, a great deal of power is required in pulling out the sheets from between the conveying roller and the separating roller, making removal of sheets by pulling a troublesome task.

DETAILED DESCRIPTION

Figure 1:
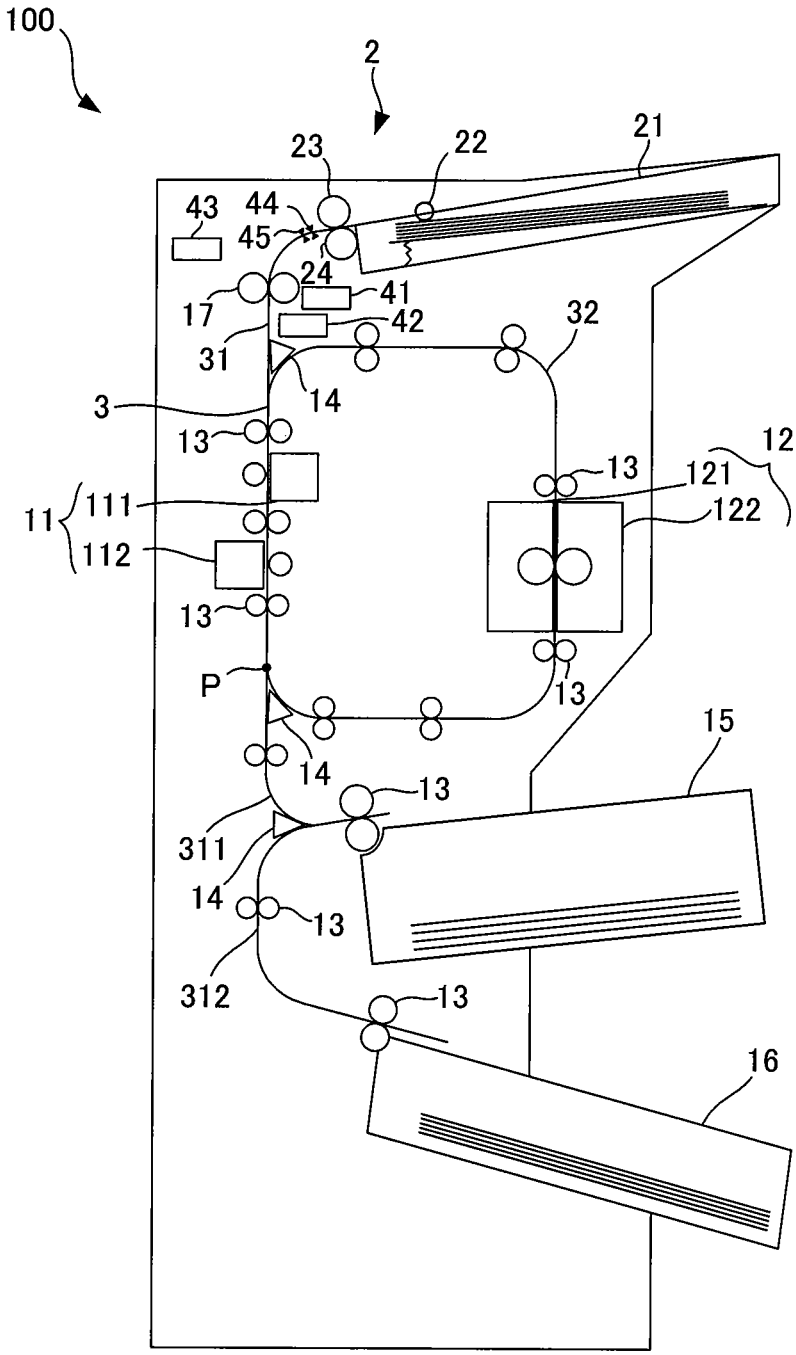
FIG. 1 shows the structure of an erasing apparatus.

Generally, a sheet feeding device of embodiments includes a conveying roller, a shaft, a separating roller, and a controller. The conveying roller rotates in a first direction and conveys a sheet downstream in a conveying direction. The shaft connects through an one-way clutch structure to the conveying roller, rotates in the first direction and a second direction opposite to the first direction, transmits the torque to the conveying roller to cause the conveying roller to rotate in the first direction if the shaft rotates in the first direction. The shaft does not transmit the torque to the conveying roller if the shaft rotates in the second direction. The shaft limits the rotation of the conveying roller in the second direction while the shaft is in a rotation-stop state. The separating roller is arranged opposite to the conveying roller and forms a nip to nip the sheet. The controller has a first mode in which the shaft is rotated in the first direction to cause the conveying roller to rotate in the first direction, and a second mode in which the shaft is rotated in a second direction to allow rotation of the conveying roller in the second direction.

Embodiments are described below by referring to the drawings.

FIG. 1 shows the structure of an erasing apparatus 100.

The erasing apparatus 100 performs "a decolorizing process (erasing process)" on a sheet on which an image has been formed with a "decolorable color material (erasable color material)" such as decolorable toner and a decolorable ink, thereby decolorizing the image formed with the decolorable color material. Examples of such a decolorable color material may include color-forming compounds, color-developing agents, and decolorizing agents. Examples of such a color-forming compound may include leuco dyes. Examples of such a color-developing agent may include phenols. Examples of such a decolorizing agent may include compounds that are compatible with a color-forming compound when heated and have no affinity for a color-developing agent. The decolorable color material can produce colors by the interaction with a color-forming compound and a color-developing agent, and can be decolorized by heating at a decolorizing temperature or higher due to the blocking of the interaction with the color-forming compound and the color-developing agent.

The erasing apparatus 100 includes a sheet feeding unit 2 (sheet feeding device), a conveying path 3, registration rollers 17, a reading unit 11, an erasing unit 12, sheet conveying rollers 13, flappers 14, and first and second sheet discharge trays 15 and 16.

The sheet feeding unit 2 includes a sheet feeding tray 21 (sheet stacking section), a pickup roller 22, a conveying roller 23, a separating roller 24, first, second and third motors 41, 42 and 43, a sheet-feed detecting sensor 44, and a multi-feed detecting sensor 45. The sheet feeding unit 2 takes one sheet out of the sheet feeding tray 21, and feeds the sheet to the conveying path 3.

The conveying path 3 includes first and second conveying paths 31 and 32. The first conveying path 31 extends from the sheet feeding tray 21. The reading unit 11, and the first and second sheet discharge trays 15 and 16 are provided along the first conveying path 31 in this order as viewed from an upstream side of a direction in which sheets are conveyed. The second conveying path 32 branches off the first conveying path 31 at a position downstream of the sheet conveying direction with respect to the reading unit 11, and joins the first conveying path 31 at a position upstream of the sheet conveying direction with respect to the reading unit 11. The first conveying path 31 includes a first switchback conveying path 311 extending from a branching point P of the second conveying path 32 downstream in the sheet conveying direction to lead to the first sheet discharge tray 15, and a second switchback conveying path 312 branching off the first switchback conveying path 311 to lead to the second sheet discharge tray 16.

Figure 2:
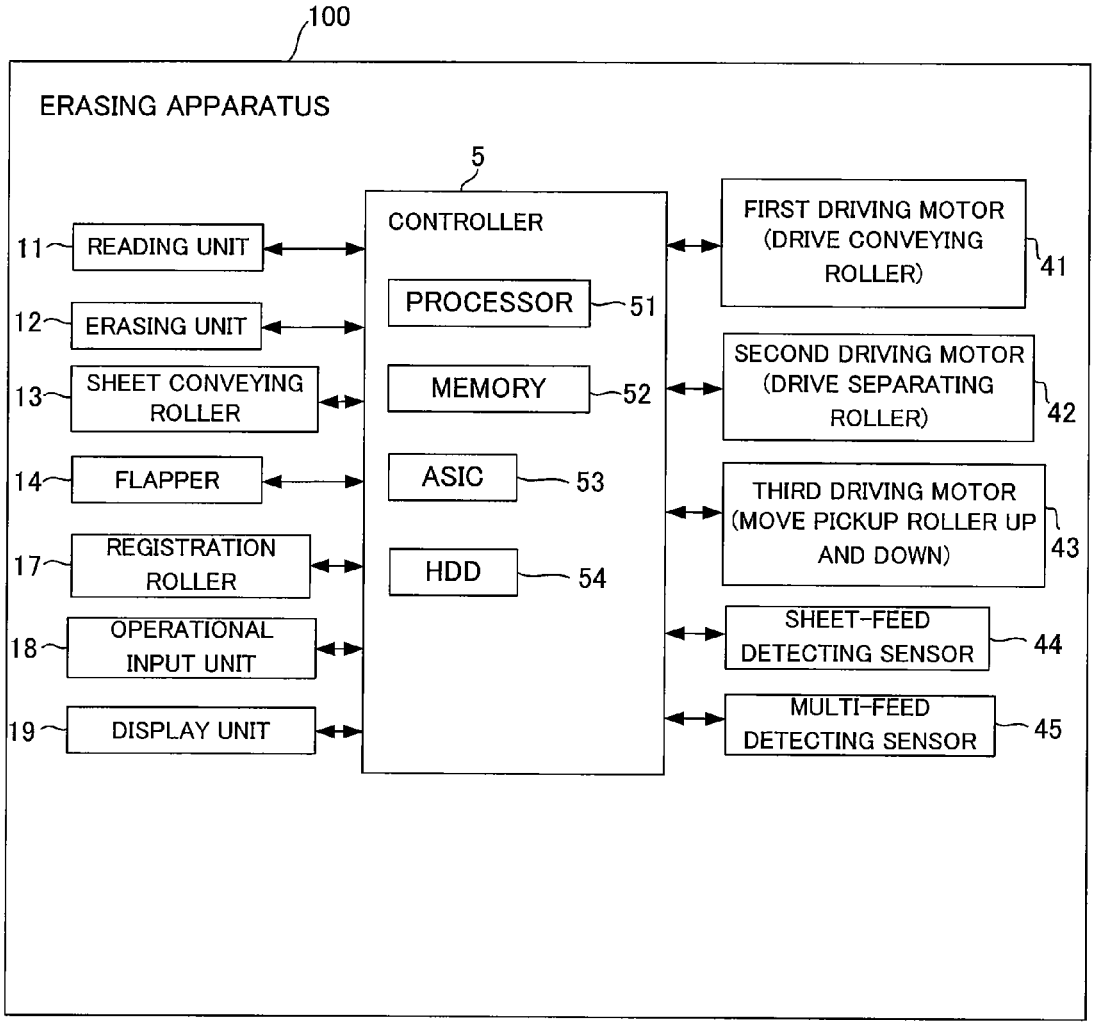
FIG. 2 is a block diagram showing the hardware structure of the erasing apparatus.

The reading unit 11 includes two reading units 111 and 112, and reads both sides of a sheet at one time. Image data read by the reading unit 11 is stored in a memory 53 (FIG. 2). The image data stored in the memory 33 can be used in reconstructing an image by retrieving the image data after the image is erased from a sheet.

The erasing unit 12 includes two erasing units 121 and 122. The erasing unit 12 decolorizes images on both sides of a sheet at one time by heating the both sides of the sheet with the erasing units 121 and 122 in abutting contact with the both sides of the sheet.

The sheet conveying rollers 13 are provided at a plurality of positions along the conveying path 3, and convey a sheet held therebetween.

The flappers 14 are provided at respective branching points of the conveying path 3, and pass a sheet to one of branching paths.

Image erasing process performed by the erasing apparatus 100 is described briefly below.

The erasing apparatus 100 causes the sheet feeding unit 2 to take one sheet out of the sheet feeding tray 21, and to feed the sheet to the conveying path 3. The erasing apparatus 100 feeds the sheet to the reading unit 11 to read images on both sides of the sheet. The erasing apparatus 100 feeds the sheet to the erasing unit 12 to erase the images on the both sides of the sheet by heating the both sides of the sheet. The erasing apparatus 100 returns the sheet to the reading unit 11 to read the both sides of the sheet again.

The erasing apparatus 100 passes the sheet to the first switchback conveying path 311 at the branching point P. If determining based on image data about the both sides of the sheet that there is no unerased part or no corner bend on the both sides of the sheet and that the sheet is reusable, the erasing apparatus 100 discharges the sheet onto the first sheet discharge tray 15. If determining that there is unerased part or corner bend on either side of the sheet and that the sheet is not reusable, the erasing apparatus 100 causes the sheet to be switch-back conveyed to the second switchback conveying path 312, and discharges the sheet onto the second sheet discharge tray 16.

FIG. 2 is a block diagram showing the hardware structure of the erasing apparatus 100.

The erasing apparatus 100 includes, in addition to the constituting elements described above, a controller 5, an operational input unit 18, and a display unit 19.

The controller 5 includes a processor 51, an ASIC (application specific integrated circuit) 52, a memory 53, and a HDD (hard disk drive) 54, and controls the entire erasing apparatus 100.

The operational input unit 18 includes a touch panel and operational keys, for example, and accepts entry of operation by a user. The erasing apparatus 100 allows operation of only reading a sheet without erasing an image. The operational input unit 18 gives instructions about the functional operation of the erasing apparatus 100 such as start of the erasing process or reading of an image on a sheet.

The display unit 19 is composed of a touch panel, for example. The display unit 19 displays setting information, operating status and log information about the erasing apparatus 100, and notification to a user.

Figure 3:
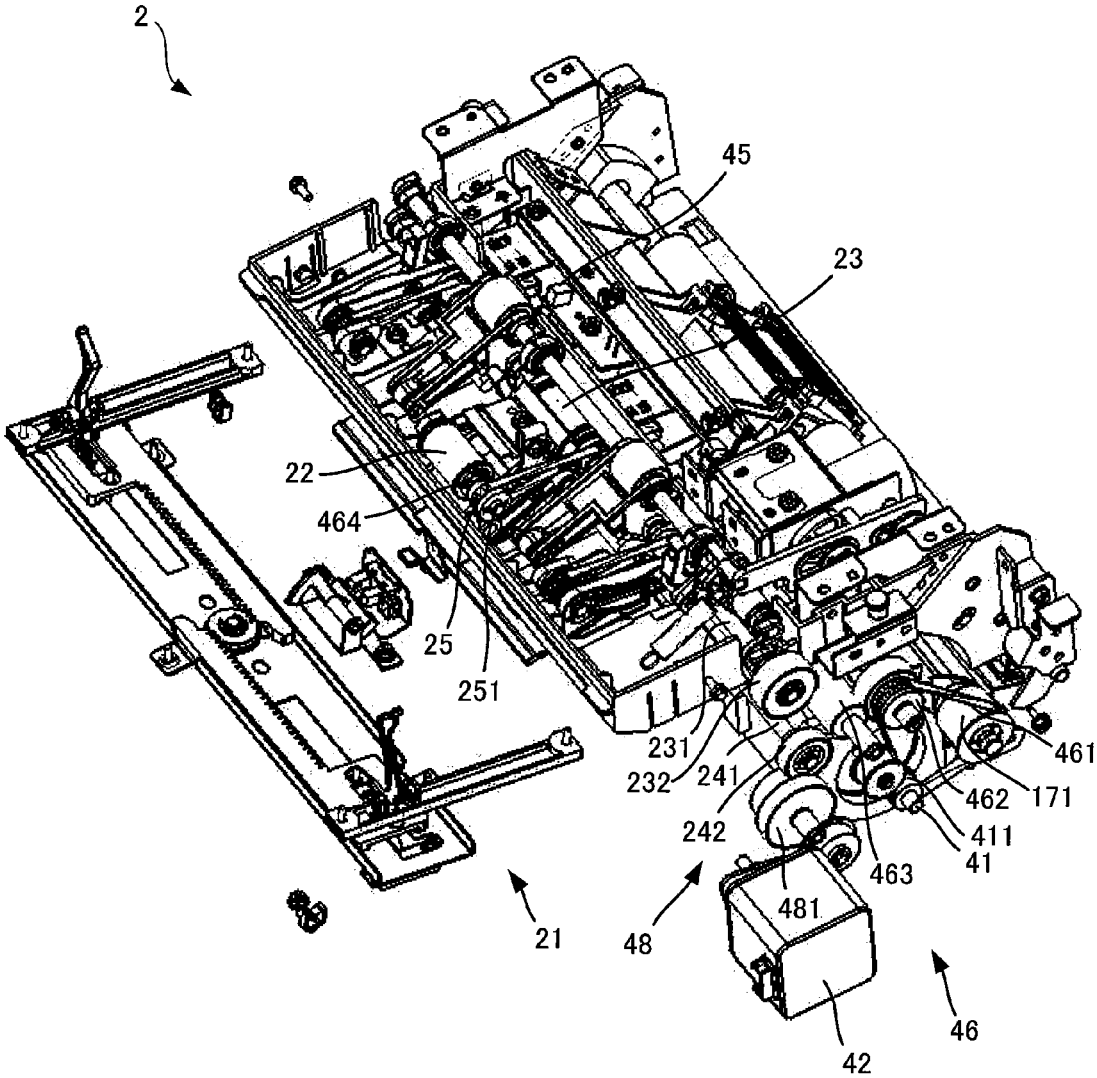
FIG. 3 is a perspective view showing the structure of a sheet feeding unit.
Figure 4:
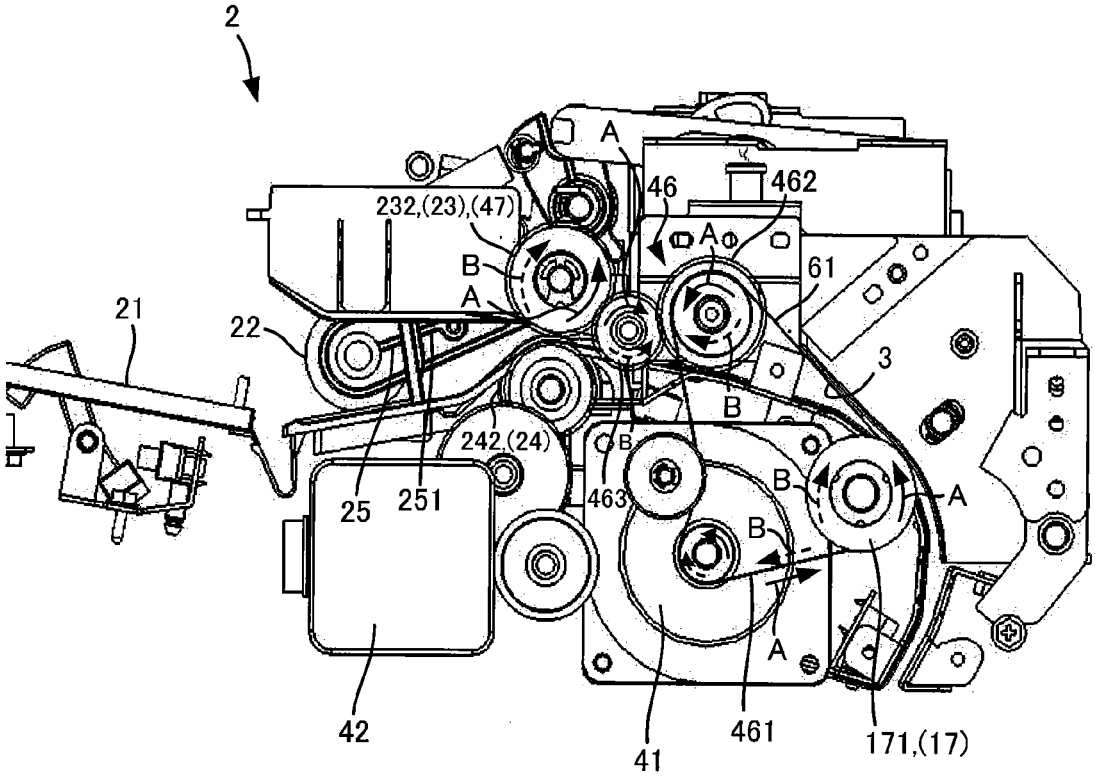
FIG. 4 is a side view showing the structure of the sheet feeding unit.

FIGS. 3 and 4 show the structure of the sheet feeding unit 2. In FIG. 3, a cover such as that of the sheet feeding tray 21 is not shown.

The sheet feeding tray 21 holds a plurality of sheets stacked therein. Various sheet sizes including A4-R, A4, and LTR are acceptable.

The sheet feeding unit 2 includes, in addition to the elements 21 to 24 and 41 to 45 described above, a pickup roller actuating section 25, a first torque transmitting mechanism 46, and a second torque transmitting mechanism 48.

The pickup roller 22 is in contact with the uppermost sheet of a bundle of sheets placed in the sheet feeding tray 21, and then rotates. The pickup roller 22 takes the sheet out of the sheet feeding tray 21, and feeds the sheet in between the conveying roller 23 and the separating roller 24.

The pickup roller actuating section 25 vertically moves the pickup roller 22, thereby positioning the pickup roller 22 between a sheet feed position at which the pickup roller 22 is capable of taking a sheet out of the sheet feeding tray 21 and a standby position at which the pickup roller 22 cannot take out a sheet. The pickup roller actuating section 25 includes the third motor 43, and an arm 251 driven by the third motor 43 to vertically move the pickup roller 22.

The conveying roller 23 and the separating roller 24 are provided as a pair, and work cooperatively to form a nip therebetween. If sheets are multi-fed in the nip from the pickup roller 22, the conveying roller 23 and the separating roller 24 separate one of the sheets, and feed the separated sheet to the conveying path 3. The conveying roller 23 is provided to a driving shaft 231. The driving shaft 231 connects through an one-way clutch structure 47 (FIG. 4) to the conveying roller 23. A gear 232 is provided to an end portion of the driving shaft 231. The torque of the first motor 41 is transmitted from a gear 411 of the output shaft of the first motor 41 to the one-way clutch structure 47 through a belt 461, gears 462, 463 and 232, and the driving shaft 231.

The driving shaft 231 rotates in a feed direction (first direction) and a return direction (second direction). The feed direction is a direction in which the driving shaft 231 rotates to try to cause the conveying roller 23 to rotate to feed the sheet downstream in the sheet conveying direction. The return direction is a direction in which the driving shaft 231 rotates to try to cause the conveying roller 23 to rotate to feed the sheet upstream in the sheet conveying direction.

The one-way clutch structure 47 only transmits torque acting in the feed direction from the driving shaft 231 to the conveying roller 23. If the driving shaft 231 rotates in the return direction, the one-way clutch structure 47 does not transmit torque acting in the return direction from the driving shaft 231 to the conveying roller 23, and the conveying roller 23 is allowed to rotate in the return direction if torque acting in the return direction is applied from out to the conveying roller 23.

A belt 464 is wound around the driving shaft 231 of the conveying roller 23 and a driving shaft of the pickup roller 22. The pickup roller 22 rotates in a direction in which the driving shaft 231 of the conveying roller 23 is driven.

The first torque transmitting mechanism 46 transmits the torque of the first motor 41 to the conveying roller 23. The first torque transmitting mechanism 46 includes the belt 461, the gears 462, 463 and 232, and the driving shaft 231.

The second torque transmitting mechanism 48 transmits the torque of the second motor 42 to the separating roller 24. The second torque transmitting mechanism 48 includes the gears 481 and 242, and the driving shaft 241 of the separating roller 24. The driving shaft 241 comprises a torque limiter.

A gear 242 is provided to an end portion of a driving shaft 241 of the separating roller 24. The torque of the second motor 42 is transmitted from the second motor 42 to the separating roller 24 through gears 481 and 242 and the driving shaft 241. Torque acting in the return direction to cause a sheet to return upstream in the sheet conveying direction is transmitted from the second motor 42 to the separating roller 24.

By the action of the torque limiter, the separating roller 24 rotates in the feed direction (third direction) in response to the convey of the sheet being conveyed downstream in the sheet conveying direction if the force which is transmitted to the separating roller 24 via the sheet conveyed downstream in the sheet conveying direction by the conveying roller 23 is bigger than a predetermined value. By the action of the torque limiter, the separating roller 24 rotates in the return direction if the force which is transmitted to the separating roller 24 is smaller than the predetermined value.

For example, if sheets are multi-fed in the nip between the conveying roller 23 and the separating roller 24, only one of the sheets multi-fed in the nip between the conveying roller 23 and the separating roller 24 and on the side on which the conveying roller 23 is placed is conveyed downstream in the sheet conveying direction, and the sheets on the side on which the separating roller 24 is placed is stopped or returned upstream in the sheet conveying direction, thereby separating the sheets.

The registration rollers 17 are provided along the conveying path 3 and downstream of the sheet conveying direction with respect to the conveying roller 23 and the separating roller 24. The registration rollers 17 are provided in a pair. A gear 171 provided to a driving shaft of one of the registration rollers 17 is shown in FIGS. 3 and 4. In this configuration, an end portion of a sheet is brought into abut contact with a nip between the registration rollers 17 in a pair, whereby the registration rollers 17 correct the posture of the sheet such that the end portion of the sheet extends in a direction perpendicular to the sheet conveying direction. The gear 171 is provided to an end portion of the driving shaft of the registration roller 17 shown in FIGS. 3 and 4, and the belt 461 driven by the first motor 41 is looped over the gear 171. The driving shaft of the registration rollers 17 connects through an one-way clutch structure to the registration roller 17.

As shown in FIG. 4, if the first motor 41 drives the belt 461 in the anticlockwise direction indicated by a solid arrow A of FIG. 4 when a sheet is picked up, torque acting in the anticlockwise direction (feed direction) and trying to drive the conveying roller 23 in the feed direction is input into the driving shaft 231 of the conveying roller 23. Then, by the action of the one-way clutch structure 47, torque acting in the feed direction is transmitted from the driving shaft 231 to the conveying roller 23. By this torque, the conveying roller 23 is driven in the feed direction corresponding to the anticlockwise direction to convey the sheet downstream in the sheet conveying direction.

At this time, torque acting in the return direction and trying to drive the registration rollers 17 in the return direction is input into the driving shaft of the registration rollers 17. However, by the action of the one-way clutch structure, the torque from the first motor 41 is not transmitted to the registration rollers 17.

Meanwhile, if the first motor 41 drives the belt 461 in the clockwise direction indicated by a dashed arrow B of FIG. 4, torque acting in the clockwise direction (return direction) and trying to drive the conveying roller 23 in the return direction is input into the driving shaft 231 of the conveying roller 23. In this case, by the action of the one-way clutch structure 47, the torque from the first motor 41 is not transmitted to the conveying roller 23.

At this time, torque acting in the clockwise direction (feed direction) indicated by a dashed arrow B of FIG. 4 and trying to drive the registration rollers 17 in the feed direction is input into the driving shaft of the registration rollers 17. Then, by the action of the one-way clutch structure, the torque from the driving shaft (first motor 41) is not transmitted to the registration rollers 17. In response, the registration rollers 17 are driven in the feed direction to convey the sheet downstream in the sheet conveying direction.

As described above, in the sheet feeding unit 2, if the first motor 41 is driven in one direction (fifth direction), the conveying roller 23 is rotated in the feed direction (first direction) by the torque from the first motor 41 while the registration rollers 17 are not driven. Meanwhile, if the first motor 41 is driven in the opposite direction (sixth direction), the registration rollers 17 are in turn rotated by the torque from the first motor 41 while the conveying roller 23 is not rotated.

The sheet-feed detecting sensor 44 detects a sheet in the conveying path 3. The sheet-feed detecting sensor 44 may include an infrared light emitting section to emit infrared light and a light receiving section to receive infrared light. The sheet-feed detecting sensor 44 may be such a sensor that detection of a sheet by the sheet-feed detecting sensor 44 becomes ON if the sheet interrupts infrared light so that the amount of the infrared light received becomes the same as or smaller than a predetermined amount.

The multi-feed detecting sensor 45 determines if sheets are being multi-fed. The multi-feed detecting sensor 45 may be the ultrasonic wave sensor including an ultrasonic wave emitting section to emit an ultrasonic wave and a sound receiving section to receive an ultrasonic wave. The controller 5 monitors the output signal from the multi-feed detecting sensor 45 and determines that sheets are multi-fed if the amount of attenuation of the ultrasonic wave becomes the same as or larger than a predetermined amount.

The sheet-feed detecting sensor 44 and the multi-feed detecting sensor 45 are placed downstream of the sheet conveying direction with respect to the conveying roller 23 and the separating roller 24. The sheet-feed detecting sensor 44 and the multi-feed detecting sensor 45 detect part on the downstream of the sheet conveying direction of a sheet held between the conveying roller 23 and the separating roller 24. The sheet to be detected has the smallest size of those of sheets targeted for the process by the erasing apparatus 100. The sheet-feed detecting sensor 44 is placed upstream of the sheet conveying direction with respect to the multi-feed detecting sensor 45.

Figure 5:
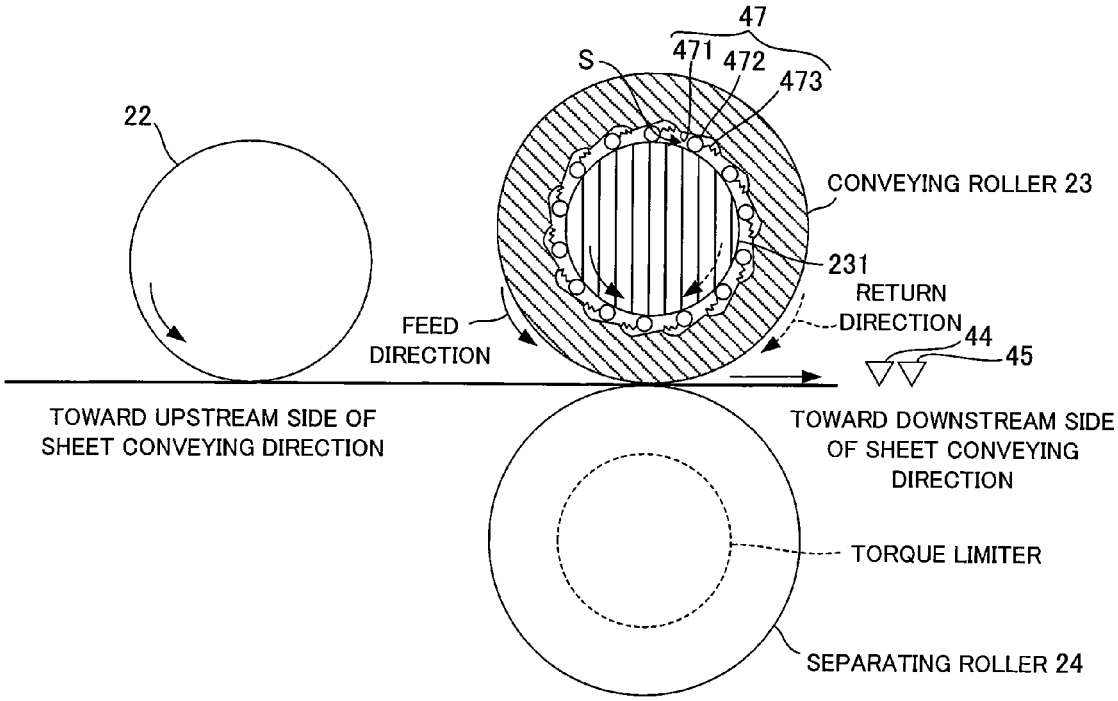
FIG. 5 is a schematic view showing an example of a built-in one-way clutch.

FIG. 5 is a schematic view showing an example of the one-way clutch structure 47. In FIG. 5 and following FIGS. 6 to 8 following FIG. 5, the conveying roller 23 and the one-way clutch structure 47 are shown schematically in cross section in order to illustrate the structures thereof.

The built-in one-way clutch structure 47 has a plurality of wedged recesses 471 formed on the inner circumference of the conveying roller 23, and balls 472 and springs 473 provided between corresponding ones of the wedged recesses 471 and the driving shaft 231 of the conveying roller 23. A wedged space S is formed between each of the wedged recesses 471 and the driving shaft 231 of the conveying roller 23. The wedged space S becomes smaller as it extends farther in the anticlockwise direction in FIG. 5. The spring 473 in each wedged space S is disposed such that the spring 473 extends in the clockwise direction with respect to the ball 472 where the wedged space S spreads.

As described above, the controller 5 drives the first motor 41 being a driving source for the conveying roller 23 in one direction and in the opposite direction. The controller 5 has a first mode (normal convey mode) in which the first motor 41 is driven to cause the conveying roller 23 to rotate in the feed direction, and a second mode (reversed convey mode) in which the first motor 41 is caused to rotate in a direction opposite to the direction in the first mode to allow rotation of the conveying roller 23 in the return direction.

The actions of the conveying roller 23 and the separating roller 24 in each mode are described next.

When the pickup roller 22 picks up a sheet, the controller 5 performs the first mode to cause the conveying roller 23 to rotate in the feed direction. In the first mode, torque acting in the anticlockwise direction indicated by a solid arrow of FIG. 5 and trying to cause the conveying roller 23 to rotate in the feed direction is transmitted from the first motor 41 to the driving shaft 231, thereby causing the driving shaft 231 to rotate in the anticlockwise direction in FIG. 5. In response, each of the balls 472 moves in the anticlockwise direction against spring force to be pushed in between a corresponding one of the wedged recesses 471 and the driving shaft 231, thereby causing the conveying roller 23 to rotate in the feed direction corresponding to the anticlockwise direction in FIG. 6. In the first mode, torque is transmitted from the driving shaft 231 of the conveying roller 23 to the pickup roller 22 through the belt 464. This causes the pickup roller 22 to rotate in the feed direction in which a sheet is fed in between the conveying roller 23 and the separating roller 24.

Figure 6:
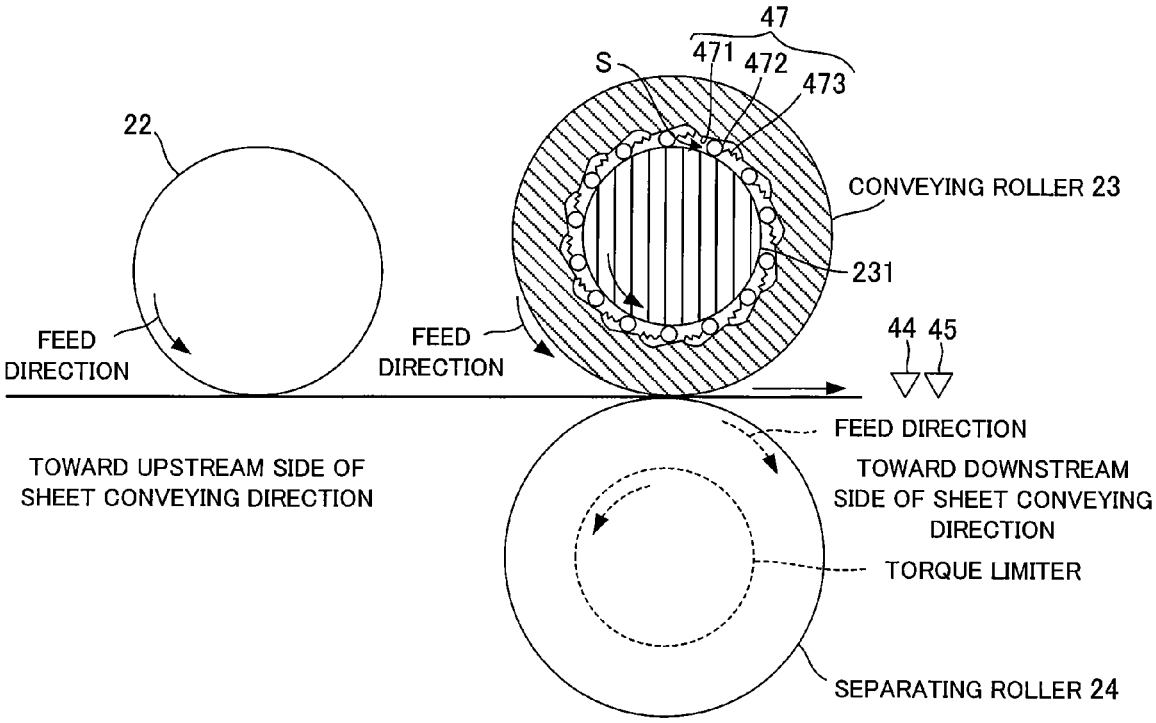
FIG. 6 shows how the conveying roller is caused to rotate in a feed direction.

The controller 5 also drives the second motor 42 when driving the first motor 41 to drive the conveying roller 23 in the feed direction. Thus, torque trying to cause the separating roller 24 to rotate in the return direction corresponding to the anticlockwise direction in FIG. 6 is transmitted from the second motor 42 to the torque limiter of the separating roller 24.

If the pickup roller 22 feeds only one sheet in the nip between the conveying roller 23 and the separating roller 24, the conveying roller 23 rotates in the feed direction. Further, torque acting in the return direction corresponding to the anticlockwise direction in FIG. 6 is transmitted from the second motor 42 to the separating roller 24. Torque acting in the feed direction is transmitted from the conveying roller 23 through the sheet. Thus, by the action of the torque limiter, the separating roller 24 is caused to rotate in response to the rotation of the conveying roller 23, so that the separating roller 24 rotates in the feed direction (third direction). Thus, the sheet is fed downstream in the sheet conveying direction.

Meanwhile, if sheets are multi-fed in the nip between the conveying roller 23 and the separating roller 24, the conveying roller 23 conveys one of the sheets on the on which the conveying roller 23 is placed downstream in the sheet conveying direction. If weak frictional force is applied between the sheets, only a low degree of torque (frictional force) is transmitted from the conveying roller 23 to a sheet below the sheet conveyed by the conveying roller 23. Thus, the torque from the second motor 42 to the separating roller 24 acting in the return direction corresponding to the anticlockwise direction in FIG. 6 becomes greater than the torque from the conveying roller 23 to the separating roller 24. Accordingly, the separating roller 24 is caused to rotate in the return direction (fourth direction). As a result, of the sheets multi-fed in the nip between the conveying roller 23 and the separating roller 24, only one sheet on the on which the conveying roller 23 is placed is conveyed downstream in the sheet conveying direction, and travel of the sheet on the side on which the separating roller 24 is placed is stopped by the separating roller 24.

Meanwhile, strong frictional force may be applied between sheets if the sheets are a bundle of sheets from which a staple has been removed, for example. In this case, like in the case where only one sheet is fed in the nip between the conveying roller 23 and the separating roller 24, the conveying roller 23 conveys the multi-fed sheets downstream in the sheet conveying direction. Then, the multi-feed of the sheets is detected by the multi-feed detecting sensor 45.

Conventionally, in response to multi-feed of the sheets, the first and second motors 41 and 42 are stopped to stop drive of the conveying roller 23 and the separating roller 24. If a user pulls out the sheets upstream in the sheet conveying direction while the first motor 41 is stopped and the driving shaft 231 of the conveying roller 23 is fixed, the conveying roller 23 rotates slightly in the return direction (clockwise direction in FIG. 6). Then, each of the balls 472 is pushed in between a corresponding one of the wedged recesses 471 and the driving shaft 231, thereby stopping rotation of the conveying roller 23. To be specific, if the conveying roller 23 rotates in the return direction while rotation of the first motor 41 is stopped, the one-way clutch structure 47 limits rotation of the conveying roller 23 in the return direction. Accordingly, a great deal of power is required in pulling out the sheets from between the conveying roller 23 and the separating roller 24 in a conventional case (only the separating roller 24 is caused to rotate in return direction by the action of the torque limiter thereof).

Figure 7:
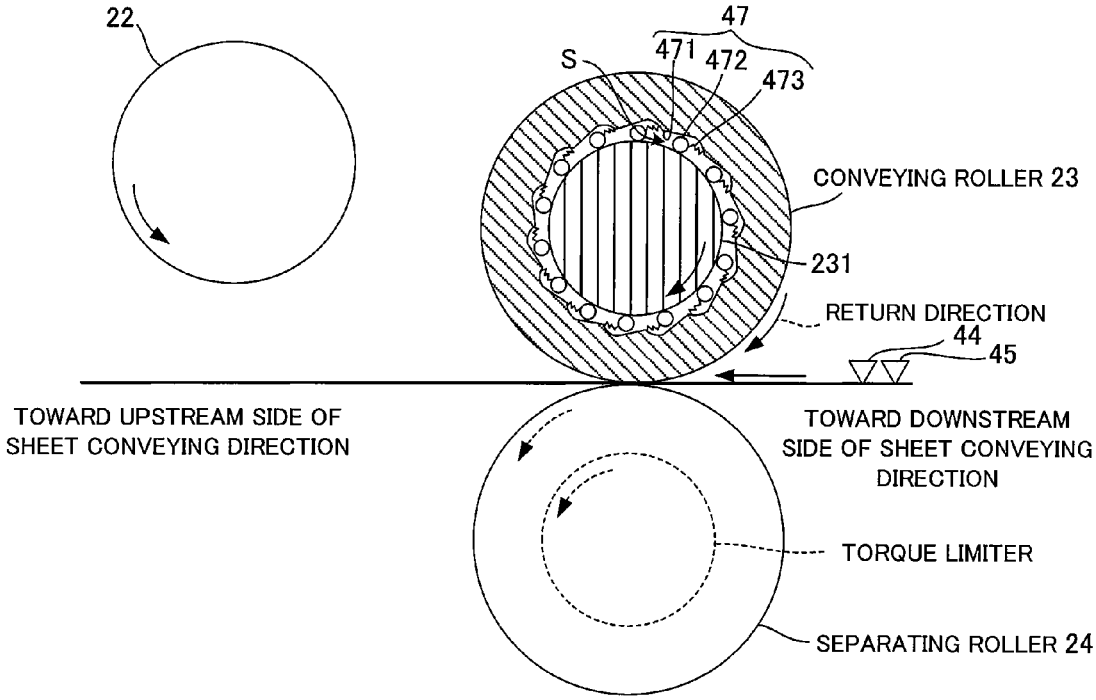
FIG. 7 shows a condition that allows rotation of the conveying roller in the return direction.

In the present embodiment, the controller 5 performs the second mode if multi-feed of sheets is detected. The controller 5 drives the pickup roller actuating section 25 to move the pickup roller 22 from the sheet feed position to the standby position at which the pickup roller 22 is placed upside. In the second mode, the controller 5 causes the first motor 41 to rotate in a direction opposite to the direction in the first mode. In response, as shown in FIG. 7, the driving shaft 231 rotates in the clockwise direction in FIG. 7 as the return direction. Then, the balls 472 of one-way clutch structure 47 are placed at extensively spreading parts of corresponding ones of the wedged spaces S and run idle in these parts. Accordingly, the conveying roller 23 is in a condition that allows rotation of the conveying roller 23 in the return direction. Accordingly, if the sheets are pulled out by hand from between the conveying roller 23 and the separating roller 24 while the conveying roller 23 is in this condition, the conveying roller 23 is caused to rotate in the return direction in response to removal of the sheets by pulling. Accordingly, the sheets can be pulled out by less power than that conventionally required.

In the present embodiment, if multi-feed of sheets is detected, the controller 5 drives the first motor 41 to place the conveying roller 23 in the condition that allows rotation of the conveying roller 23 in the return direction. At the same time, the controller 5 also drives the second motor 42 to drive the separating roller 24 in the return direction (fourth direction). Accordingly, the separating roller 24 rotates in the return direction to automatically cause the sheets to return upstream in the sheet conveying direction. At this time, the conveying roller 23 is driven to rotate in the return direction in response to the return of the sheets.

The controller 5 continues to drive the separating roller 24 and the conveying roller 23 to cause the sheets to return upstream in the sheet conveying direction until detection of a sheet by the sheet-feed detecting sensor 44 becomes OFF. Then, the controller 5 returns to normal conveying operation. If only one sheet can be separated by the conveying roller 23 and the separating roller 24, the controller 5 feeds the separated sheet downstream in the sheet conveying direction. If one sheet cannot be separated, the controller 5 causes sheets to return upstream in the sheet conveying direction again.

Figure 8:
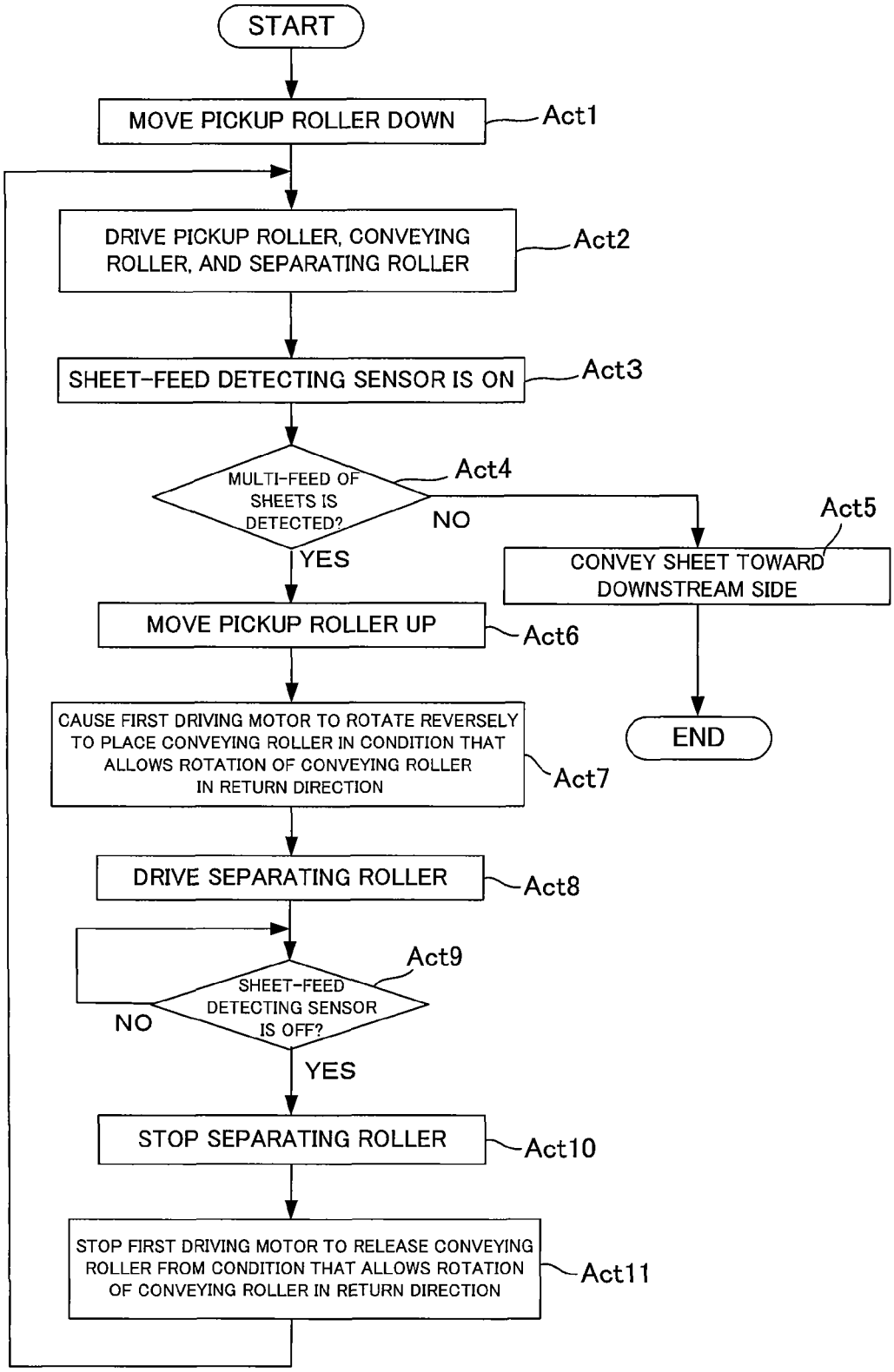
FIG. 8 is a flowchart explaining sheet feeding process performed by the erasing apparatus.
Figure 9:
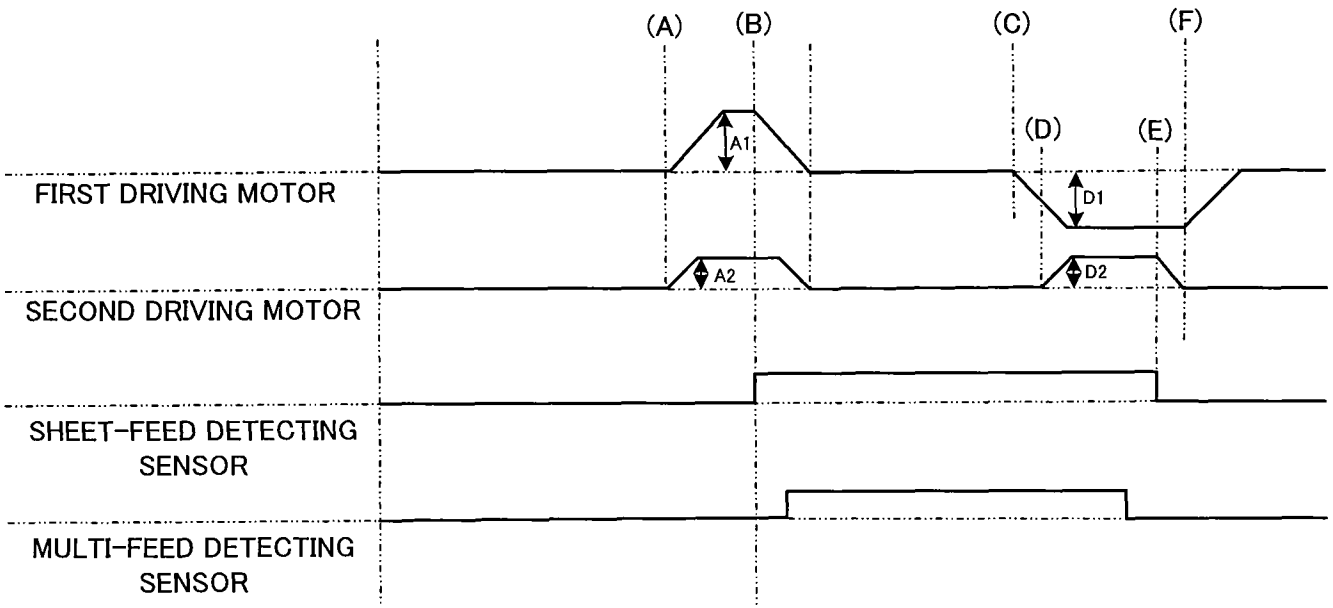
FIG. 9 is a timing chart explaining timing of each constituting element in the case of detection of multi-feed.

Sheet feeding process performed by the erasing apparatus 100 is described briefly below. The controller 5 reads a program from the memory 53 to realize the sheet feeding process by the erasing apparatus 100. FIG. 8 is a flowchart explaining the sheet feeding process. FIG. 9 is a timing chart explaining timing of drive of each constituting element and timing of detection by the sensors in the case of detection of multi-feed.

The controller 5 initially performs the first mode corresponding to the normal convey mode. First, the controller 5 causes the pickup roller actuating section 25 to move the pickup roller 22 down to place the pickup roller 22 at the sheet feed enabling position at which the pickup roller 22 is in contact with the uppermost sheet of a bundle of sheets placed in the sheet feeding tray 21 (Act 1).

The controller 5 drives the first motor 41 to drive the conveying roller 23 in the feed direction. At this time, torque is transmitted from the conveying roller 23 to the pickup roller 22, so that the pickup roller 22 feeds the sheet in between the conveying roller 23 and the separating roller 24. The controller 5 simultaneously drives the second motor 42 to input torque acting in the return direction trying to cause the separating roller 24 to rotate in the return direction into the torque limiter of the separating roller 24 (Act 2, see (A) of FIG. 9). The torque acting in the return direction input into the torque limiter of the separating roller 24 at this time is lower than the torque acting in the feed direction input into the conveying roller 23 (see A1>A2 of FIG. 9).

Accordingly, if only one sheet is conveyed in between the conveying roller 23 and the separating roller 24, the sheet is conveyed downstream in the sheet conveying direction by the conveying roller 23. By the action of the torque limiter of the separating roller 24, the separating roller 24 is driven to rotate in the feed direction in response to movement of the sheet downstream in the sheet conveying direction.

If sheets are multi-fed in between the conveying roller 23 and the separating roller 24, only a single sheet on the side on which the conveying roller 23 is placed is normally conveyed downstream in the sheet conveying direction by the conveying roller 23 due to the weak frictional force applied between the sheets. The separating roller 24 stops travel of the other sheet on the side on which the separating roller 24 is placed, reduces the speed of travel of this sheet, or causes this sheet to return upstream in the sheet conveying direction.

If tightly contacting sheets that are a bundle of sheets from which a staple has been removed are multi-fed in between the conveying roller 23 and the separating roller 24, for example, the sheets are conveyed without separating from each other downstream in the sheet conveying direction by the conveying roller 23.

the sheet-feed detecting sensor 44 detects the sheet fed downstream in the sheet conveying direction by the conveying roller 23 and the separating roller 24 (Act 3).

If only one sheet is conveyed in between the conveying roller 23 and the separating roller 24, and if sheets are separated from each other to become separated sheets between the conveying roller 23 and the separating roller 24, the controller 5 detects, based on the output signal from the multi-feed detecting sensor 45, that the sheet is not multi-fed (Act 4, NO). In this case, the controller 5 controls the conveying roller 23, the separating roller 24, the registration rollers 17, the sheet conveying rollers 13 provided at various places along the conveying path 3 and the like, thereby conveying the sheet downstream in the sheet conveying direction (toward the reading unit 11) (Act 5).

If sheets are not separated from each other between the conveying roller 23 and the separating roller 24, the controller 5 detects, based on the output signal from the multi-feed detecting sensor 45, that the sheet is multi-fed (Act 4, YES). In this case, the controller 5 switches from the first mode to the second mode in which the sheets are caused to return upstream in the sheet conveying direction. The controller 5 stops the first motor 41 to stop drive of the conveying roller 23. Later, the controller 5 stops the second motor 42 to input torque acting in the return direction into the separating roller 24 (see (B) of FIG. 9 and the like). The controller 5 causes the pickup roller actuating section 25 to move the pickup roller 22 up to place the pickup roller 22 at the standby position at which the pickup roller 22 is spaced away from the bundle of sheets (Act 6).

The controller 5 causes the first motor 41 to rotate reversely to input torque acting in the return direction. Then, by the action of the one-way clutch structure 47, the torque acting in the return direction is not transmitted to the conveying roller 23 and conveying roller 23 is in a condition that allows rotation of the conveying roller 23 in the return direction (Act 7, see (C) of FIG. 9 and the like).

After reverse rotation of the first motor 41 is started, the controller 5 also starts to drive the second motor 42 together with the first motor 41 (Act 8, see (D) of FIG. 9). The controller 5 inputs torque trying to cause the separating roller 24 to rotate in the return direction into the torque acting in the return direction limiter of the separating roller 24.

Thus, the separating roller 24 starts to rotate in the return direction after the conveying roller 23 is placed in the condition that allows rotation of the conveying roller 23 in the return direction. Then, the sheets are conveyed upstream in the sheet conveying direction by the separating roller 24, and the conveying roller 23 is caused to rotate in the return direction in response to the convey of the sheets upstream in the sheet conveying direction.

At this time, the controller 5 drives the first and second motors 41 and 42 at such respective speeds that the speed of rotation of the driving shaft 231 of the conveying roller 23 in the return direction becomes the same as or larger than the speed of rotation of the conveying roller 23 rotating in response to the convey of the sheet by the conveying roller 23

(the separating roller 24) in conveying direction upstream (in response to rotation of the separating roller 24) (see D1>D2 in FIG. 9). BY the way, if the speed of rotation of the conveying roller 23 in the return direction becomes higher than that of the driving shaft 231, the balls 472 are pushed in between corresponding ones of the wedged recesses 471 and the driving shaft 231, thereby limiting rotation of the conveying roller 23 in the return direction. However, in the present embodiment, the first and second motors 41 and 42 are controlled such that the speed of rotation of the driving shaft 231 becomes higher than the speed of rotation of the conveying roller 23 in the return direction. As a result, the one-way clutch structure 47 does not limit rotation of the conveying roller 23 in the return direction.

The controller 5 causes the angular acceleration of the first motor 41 not to fall below the angular acceleration of the second motor 42 (In the present embodiment, The controller 5 causes the angular acceleration of the first motor 41 to become the same as the angular acceleration of the second motor 42). The angular acceleration of the first motor 41 is determined when the controller 5 causes the first motor 41 to rotate in a direction opposite to a direction in the first mode to allow rotation of the conveying roller 23 in the return direction. The angular acceleration of the second motor 42 is determined when the controller 5 causes the separating roller 24 to start to rotate in the return direction. In the present embodiment, the angular acceleration of the first motor 41 is set to be substantially the same as the angular acceleration of the second motor 42. Thus, in the present embodiment, limitations to be imposed by the one-way clutch structure 47 on rotation of the conveying roller 23 in the return direction in response to the convey of a sheet being conveyed upstream in the sheet conveying direction are prevented satisfactorily. Further, in the present embodiment, a ratio between the output of the first motor 41 and torque input into the driving shaft 231 of the conveying roller 23, and a ratio between the output of the second motor 42 and torque input into the driving shaft 241 of the separating roller 24, are set at the same value.

As a result of convey of the sheets upstream in the sheet conveying direction, if detection of a sheet at the end of the upstream of the sheet conveying direction by the sheet-feed detecting sensor 44 becomes OFF, namely, if no sheet is detected by the sheet-feed detecting sensor 44 (Act 9, YES), the second motor 42 is stopped to stop drive of the separating roller 24 (Act 10, see (E) of FIG. 9).

After drive of the second motor 42 is stopped, the controller 5 stops the first motor 41 to release the conveying roller 23 from the condition that allows rotation of the conveying roller 23 in the return direction in response to the convey of a sheet being conveyed upstream in the sheet conveying direction (Act 11, see (F) of FIG. 9).

Next, the procedure returns to Act 2, specifically, returns to the first mode corresponding to the normal convey mode. Then, the conveying roller 23 and the separating roller 24 are driven again in order to separate the sheets from each other (Act 2).

In the description of the embodiments given above, the "decolorizing process (erasing process)" means decolorization of an image. However, the "decolorizing process (erasing process)" may also mean erasure of an image. To be specific, the erasing apparatus of the embodiment is not limited to a device that decolorizes an image by heating. As an example, the erasing apparatus may be a device that decolorizes an image formed on a sheet by irradiating with light, or a device that erases an image formed on a particular sheet. Or, the erasing apparatus may be a device that removes (erases) an image on a sheet. The erasing apparatus may be any apparatus as long as the apparatus have a structure that makes an image on a sheet invisible in order to allow reuse of the sheet.

In the present embodiment, the sheet feeding device is applied to the erasing apparatus. However, the sheet feeding device is also applicable to an image forming apparatus, a reading apparatus, and the like.

In the present embodiment, the sheet feeding device drives the first driving motor in a forward direction and a reverse direction to cause to rotate the driving shaft 231 of the conveying roller 23 in the feed direction (first direction) and return direction (second direction). However, the sheet feeding device may drive the first driving motor in a one direction and shift number of speed of gear train located between the first driving motor 41 and the driving shaft 231 of the conveying roller 23. In response, the sheet feeding device may drive the first driving motor in the forward direction and the reverse direction.

In the present embodiment, the one-way clutch structure 47 located between the conveying roller 23 and the driving shaft 231 of the conveying roller 23 prevents the rotation of the conveying roller 23 in the return direction. However, the one-way clutch structure may comprise a function of a torque limiter. Namely the one-way clutch structure limits the rotation of the conveying roller in the return direction (prevents the rotation of the conveying roller in the return direction) if the conveying roller receives the external torque, in the return direction, of which the amount becomes the same as or smaller than a predetermined amount while the driving shaft is in a rotation-stop state. The one-way clutch structure may cause the conveying roller to slip on the driving shaft in the return direction if the conveying roller receives the external torque, in the return direction, of which the amount becomes the same as or larger than a predetermined amount while the driving shaft is in a rotation-stop state.

A recording medium of any type is applicable if it is capable of storing a program and capable of being read by a computer. Examples of the recording medium include internal storage devices installed inside a computer such as a ROM and a RAM, portable recording media such as a CD-ROM, a flexible disk, a DVD disk, a magneto-optical disk and an IC card, databases storing a computer program, other computers capable of storing a program, or databases of such other computers. A function obtained by installation or downloading may be implemented in cooperation with an OS and the like installed in the device. A program may be entirely or partly generated dynamically as an executable module part.

The processes described in each embodiment are not necessarily performed in the order described in the present embodiment, but they can be performed in a different order.

As described in detail above, the technique described herein makes it easy to pull out a sheet from between a conveying roller and a separating roller in the sheet conveying direction upstream.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. A sheet feeding device, comprising:

a conveying roller configured to rotate in a first direction and convey a sheet in a conveying direction;

a shaft connected through an one-way clutch structure to the conveying roller, configured to rotate in the first direction and a second direction opposite to the first direction, configured to transmit torque to the conveying roller to cause the conveying roller to rotate in the first direction if the shaft rotates in the first direction, configured to not transmit the torque to the conveying roller if the shaft rotates in the second direction, and configured to limit the rotation of the conveying roller in the second direction if the shaft is in a rotation-stop state;

a separating roller arranged opposite to the conveying roller, the conveying roller and the separating roller forming a nip to nip the sheet;

a first motor configured to drive the rotation of the shaft;

a second motor configured to drive the rotation of the separating roller; and a controller configured to operate in a first mode in which the first motor drives the shaft to rotate in the first direction to cause the conveying roller to rotate in the first direction and the second motor drives the separating roller in a third direction to feed the sheet in a direction opposite to the conveying direction, and in a second mode in which the first motor drives the shaft to rotate in the second direction to allow the conveying roller to be rotated in the second direction and the second motor drives the separating roller in the same direction as in the first mode, wherein in the second mode, the controller starts the second motor after the controller starts the first motor.

2. The sheet feeding device according to claim 1, wherein the separating roller rotates in a fourth direction opposite to the third direction along with the sheet conveyed in the conveying direction if force transmitted to the separating roller via the sheet conveyed in the conveying direction by the conveying roller is bigger than a predetermined value, and rotates in the third direction if the force is smaller than the predetermined value.

3. The sheet feeding device according to claim 2, wherein in the second mode, the separating roller rotates in the third direction and conveys the sheet nipped between the separating roller and the conveying roller in the direction opposite to the conveying direction.

4. The sheet feeding device according to claim 3, further comprising:

a sensor located downstream with respect to the conveying roller in the conveying direction and configured to detect a multi-feed of sheets nipped between the separating roller and the conveying roller, wherein the controller switches from the first mode to the second mode if the controller determines that the sheets are multi-fed.

5. The sheet feeding device according to claim 4, wherein in the second mode, the controller causes a rotation rate of the shaft in the second direction to be greater than or equal to a rotation rate of the conveying roller in the second direction in response to the sheets being conveyed by the separating roller in the direction opposite to the conveying direction.

6. The sheet feeding device according to claim 5, wherein if the controller switches from the first mode to the second mode, the controller causes the conveying roller and the separating roller to stop rotating, causes the shaft to rotate in the second direction after the rotation of the conveying roller and the separating roller stops, and causes the separating roller to rotate in the third direction after causing the shaft to rotate in the second direction.

7. The sheet feeding device according to claim 1, further comprising:

a pickup roller configured to take a sheet out of a sheet stacking section in which sheets are stacked and feed the sheet between the conveying roller and the separating roller; and a pickup roller actuating section configured to cause the pickup roller to move between a sheet feed enabling position at which the pickup roller is capable of taking a sheet out of the sheet stacking section and a standby position at which the pickup roller cannot take out a sheet, wherein the controller causes the pickup roller to move from the sheet feed enabling position to the standby position, if the controller switches from the first mode to the second mode.

8. The sheet feeding device according to claim 1, wherein the controller controls the first motor to turn in a fifth direction to cause the shaft to rotate in the first direction and controls the first motor to turn in a sixth direction opposite to the fifth direction to cause the shaft to rotate in the second direction.

9. A sheet feeding method implemented by a sheet feeding device, the sheet feeding device including: a conveying roller configured to rotate in a first direction and convey a sheet in a conveying direction; a shaft connected through an one-way clutch structure to the conveying roller, configured to rotate in the first direction and a second direction opposite to the first direction, configured to transmit torque to the conveying roller to cause the conveying roller to rotate in the first direction if the shaft rotates in the first direction, configured to not transmit the torque to the conveying roller if the shaft rotates in the second direction, and configured to limit the rotation of the conveying roller in the second direction if the shaft is in a rotation-stop state; a separating roller arranged opposite to the conveying roller, the conveying roller and the separating roller forming a nip to nip the sheet; a first motor configured to drive the rotation of the shaft; a second motor configured to drive the rotation of the separating roller; and a sensor located downstream with respect to the conveying roller in the conveying direction and detect a multi-feed of sheets nipped between the separating roller and the conveying roller, the sheet feeding method comprising:

controlling, in a first mode, the first motor to drive the shaft to rotate in the first direction to cause the conveying roller to rotate in the first direction and the second motor to drive the separating roller in a third direction to feed the sheet in a direction opposite to the conveying direction; and controlling, in a second mode, the first motor to drive the shaft to rotate in the second direction to allow the conveying roller to be rotated in the second direction and the second motor to drive the separating roller in the same direction as in the first mode, wherein in the second mode, the second motor is started after the first motor is started.

10. The sheet feeding method according to claim 9, wherein the separating roller rotates in a fourth direction opposite to the third direction along with the sheet conveyed in the conveying direction if force transmitted to the separating roller via the sheet conveyed in the conveying direction by the conveying roller is bigger than a predetermined value, and rotates in the third direction if the force is smaller than the predetermined value, and wherein the sheet feeding method further comprises:

operating the second motor to drive the separating roller to rotate in the third direction to feed the sheet nipped between the separating roller and the conveying roller while the shaft rotates in the second direction, wherein a rotation rate of the shaft in the second direction is controlled to be greater than or equal to a rotation rate of the conveying roller rotating in the second direction in response to sheets being conveyed by the separating roller in the direction opposite to the conveying direction.

11. The sheet feeding method according to claim 10, further comprising:

causing the conveying roller and the separating roller to stop rotating, causing the shaft to rotate in the second direction after the rotation of the conveying roller and the separating roller stops, and causing the separating roller to rotate in the third direction after causing the shaft to rotate in the second direction, if the rotation direction of the shaft switched from the first direction to the second direction.

12. The sheet feeding method according to claim 9, wherein the first motor is controlled to turn in a fifth direction to cause the shaft to rotate in the first direction and in a sixth direction opposite to the fifth direction to cause the shaft to rotate in the second direction.

13. The sheet feeding device according to claim 1, wherein the controller controls the first motor and the second motor in the second mode so that a rotation rate of the shaft in the second direction is greater than or equal to a rotation rate of the conveying roller in the second direction.

14. The sheet feeding device according to claim 1, wherein the controller controls the first motor and the second motor in the second mode so that an angular acceleration of the shaft in the second direction is greater than or equal to an angular acceleration of the conveying roller in the second direction.

15. An erasing apparatus, comprising:

a conveying roller configured to rotate in a first direction and convey a sheet in a conveying direction;

a shaft connected through an one-way clutch structure to the conveying roller, configured to rotate in the first direction and a second direction opposite to the first direction, configured to transmit torque to the conveying roller to cause the conveying roller to rotate in the first direction if the shaft rotates in the first direction, configured to not transmit the torque to the conveying roller if the shaft rotates in the second direction, and configured to limit the rotation of the conveying roller in the second direction if the shaft is in a rotation-stop state;

a separating roller arranged opposite to the conveying roller, the conveying roller and the separating roller forming a nip to nip the sheet;

a first motor configured to drive the rotation of the shaft;

a second motor configured to drive the rotation of the separation roller;

a controller configured to operate in a first mode in which the first motor drives the shaft to rotate in the first direction to cause the conveying roller to rotate in the first direction and the second motor drives the separating roller to rotate in a third direction to feed the sheet in a direction opposite to the conveying direction, and in a second mode in which the first motor drives the shaft to rotate in the second direction to allow the conveying roller to be rotated in the second direction and the second motor drives the separating roller in the same direction as in the first mode; and an erasing unit arranged downstream with respect to the conveying roller and the separating roller in the conveying direction and configured to erase an image on the sheet conveyed by the conveying roller and the separating roller, wherein in the second mode, the controller starts the second motor after the controller starts the first motor.

* * * * *